US007327325B2

(12) United States Patent
Schadler

(10) Patent No.: US 7,327,325 B2
(45) Date of Patent: Feb. 5, 2008

(54) VERTICALLY POLARIZED TRAVELING WAVE ANTENNA APPARATUS AND METHOD

(75) Inventor: John L. Schadler, Raymond, ME (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 11/499,644

(22) Filed: Sep. 29, 2006

(65) Prior Publication Data

US 2007/0241984 A1 Oct. 18, 2007

Related U.S. Application Data

(60) Provisional application No. 60/791,887, filed on Apr. 14, 2006.

(51) Int. Cl.
*H01Q 9/16* (2006.01)

(52) U.S. Cl. ..... 343/792; 343/813

(58) Field of Classification Search ..... 343/792, 343/791, 790, 810, 801, 799, 800, 813, 814
See application file for complete search history.

(56) References Cited

U.S. PATENT DOCUMENTS 2,947,988 A 8/1960 Masters
5,506,591 A * 4/1996 Dienes ..... 343/792
6,057,804 A * 5/2000 Kaegebein ..... 343/792
6,421,024 B1 * 7/2002 Stolle ..... 343/792
2004/0056817 A1 * 3/2004 Tsai et al. ..... 343/792

OTHER PUBLICATIONS

Philip S. Carter, "Antenna Arrays Around Cylinders", Proceedings of the I.R.E., Dec. 1943, pp. 671-693, vol. 31, issue 12.

* cited by examiner

*Primary Examiner*—Hoanganh Le
(74) *Attorney, Agent, or Firm*—Baker & Hostetler LLP

(57) ABSTRACT

A vertically polarized traveling wave antenna is omnidirectional, bottom-mounted, and bottom-fed. A robust center coax provides a self-supporting mechanical structure. Multiple dipoles are capacitively coupled to the coax in quads, with a first two dipoles placed on opposite sides of the center coax and spaced by a quarter wavelength along the coax from the second two, which couple at right angles to the first two. This matched-layer spacing cancels the reactive components of the impedances of the dipoles. Beam tilt is readily incorporated over a wide range by adjusting layer spacing to add phase taper. All dipoles are oriented parallel to the coax axis, with opposite "hot" (center coupled) dipole elements oriented oppositely to each other. A radiated signal thus has rotating phase, when viewed from above, but is vertically polarized at each azimuth. A lightweight radome, provided for weather protection, is not needed for structural integrity.

20 Claims, 7 Drawing Sheets

VERTICALLY POLARIZED TRAVELING WAVE ANTENNA APPARATUS AND METHOD

CLAIM OF PRIORITY

This application claims priority to a U.S. nonprovisional application entitled, "Vertically Polarized Traveling Wave Antenna System and Method", filed Apr. 14, 2006, having Ser. No. 60/791,887, which is hereby incorporated by reference in its entirety.

FIELD OF THE INVENTION

The present invention relates generally to radiating systems. More particularly, the present invention relates to traveling-wave linear array antennas.

BACKGROUND OF THE INVENTION

It is to be understood that the term "wavelength" as used herein in reference to the physical distance between successive equal-phase locations of a radio-frequency electromagnetic signal (the sense used throughout for the term of art "RF"), has a first definition in free space, wherein signals axiomatically propagate at the speed of light (C), a second definition in air, which is slightly shorter, and additional definitions on single conductors in free space and elsewhere, in transmission lines with air or another dielectric material present between two or more conductors in whole or in part, and in waveguides, delay lines, and other environments. For example, wavelength of a gigahertz-range signal in a 50 ohm coaxial line sized for transmission of multi-watt signals, made from high-conductivity copper, and having an air dielectric with "beads" (spacer disks) of solid polytetrafluoroethylene providing about 1% fill should be calculated using a dielectric constant $\in$ of about 1.03 for the air-filled portion and about 2.0 for the PTFE portion, summing to an equivalent of around 1.05. Thus, the physical length measured in wavelengths of such a mostly-air-filled coaxial line may be on the order of 80% as long as a radiated electromagnetic signal of the same frequency in free space. For simplicity, this disclosure generally assigns a dimension for "wavelength" that is adjusted according to the propagation environment except where the effects of differing propagation rates affect apparatus operation sufficiently to introduce ambiguity.

There has recently been an industry focus on digital streaming of content to mobile, portable, and handheld receivers through terrestrial broadcast systems. This type of broadcasting is being developed for implementation in licensed UHF frequency bands such as 0.7 GHz to 1 GHz (upper L-Band: TV channel 52 and above; mobile radio) and 1 GHz to 2 GHz (lower S-band).

At L-Band frequencies, the preferred method of transmission is vertical polarization. There are at present two styles of vertically polarized antennas that are readily available for commercial use in transmission at these microwave frequencies, namely panel and whip antennas. Panel antennas are intrinsically directional in nature and are typically used to cover sectors of space. Whip antennas are nominally omnidirectional and are used preferentially in applications requiring substantially equal radiation in all azimuths.

Traditional whip antennas for UHF are limited in power handling, and are further limited in elevation radiation pattern flexibility. These antennas are, in many embodiments, constructed by interleaving collinear dipoles in an array, center feeding the array, and establishing a phase difference between the upper and lower halves of the array to provide beam tilt. A whip antenna formed from an interleaved collinear array is shown in FIG. 1.

The design shown in FIG. 1 uses dipoles that are each approximately one-half wavelength long (for a nominal frequency) and are connected to one another in parallel. The inner conductor of the first dipole is electrically connected to the outer conductor of the next dipole. This inner-to-outer interleaving at half-wave intervals compensates the radiated phase of all the dipoles so they are in phase at one-half wave (180 degree) spacing. This pattern continues until the dipole strings are terminated in shorts at the furthest positions from the center input feed.

The center feed arrangement shown in FIG. 1 inherently limits the amount of beam tilt that can be achieved, with no more than about 2 degrees of tilt possible before the elevation pattern develops a split beam and the gain is severely degraded. As is typical in parallel arrays, the dipoles add in parallel to determine the nominal gain.

One consideration in building long arrays of elements is that as array length increases, the connection of additional elements results in increased input impedance mismatch. This in turn increases the transformation ratio needed in an input feed to bring the impedance back to, for example, 50 ohms. Increasing the transformation ratio reduces input impedance bandwidth and antenna power handling capability.

Another consideration in whips using strings of dipoles is mechanical stability. The dipoles in known arrangements are mounted inside a relatively thick fiberglass tube to provide necessary mechanical support. This radome can introduce attenuation.

To summarize, the shortcomings of a vertically polarized collinear dipole antenna include:

Limited beam tilt can be realized.

Increased input loading with additional dipoles constrains input transformer performance for both power and bandwidth.

Structural support is provided largely by the radome.

Panel antennas involve tradeoffs different from those for whips. Considerations may include requirements to provide extensive systems of power dividers and feed lines where multiple panels must receive individual and carefully phased inputs, a panel or an array of panels pointing in each direction (typically four quadrants for omnidirectional capability, with gain dependent on array size), use of a tower with multiple discrete units mounted thereon, and management of significant wind loading. While very high power capability and precise beam control can be supported, high efficiency at moderate power may be uneconomical.

Accordingly, it is desirable to provide an apparatus and method for a vertically polarized traveling wave antenna that permits simplicity in its mechanical construction, minimal design adaptation to vary beam tilt and null fill, matched input impedance substantially independent of the number of elements, excellent azimuth pattern circularity, and moderate power capability.

SUMMARY OF THE INVENTION

The foregoing needs are met, to a great extent, by the present invention, wherein in one aspect a vertically polarized traveling wave antenna is provided that in some embodiments permits simplicity in its mechanical construction, minimal design adaptation to vary beam tilt and null fill, matched input impedance substantially independent of the number of elements, excellent azimuth pattern circularity, and high power capability.

In accordance with one embodiment of the present invention, a vertically polarized traveling wave antenna is presented. The antenna includes a coaxial transmission line having an inner conductor and an outer conductor with a common longitudinal axis, wherein the transmission line originates at an origination node and ends at a terminal node. The antenna further includes a dipole including a first-type element and a second-type element, wherein radiating parts of the first-type and second-type elements are substantially collinear conductors having an axis parallel to an antenna polarization axis, and wherein feed parts of the first-type and second-type elements are conductors having axes perpendicular to the polarization axis. The feed parts are connected to respective radiating parts, with the first-type element conductively coupled to the outer conductor and the second-type element capacitively coupled to the inner conductor with an effective position comprising a coupling locus, and with the second-type element feed part passing without conductive contact through an aperture in the outer conductor.

In accordance with another embodiment of the present invention, a vertically polarized traveling wave antenna is presented. The antenna includes coaxial means for propagating an electromagnetic signal, capacitive means for coupling a first portion of the signal from the coaxial means for propagating at a first location, wherein the capacitive means for coupling a first portion includes a first two discrete elements located opposite to one another with respect to a longitudinal axis of the coaxial means for propagating, and capacitive means for coupling a second portion of the signal from the coaxial means for propagating at a second location, wherein the capacitive means for coupling a second portion includes a second two discrete elements located opposite to one another with respect to a longitudinal axis of the coaxial means for propagating, wherein the first and second locations are spatially separated along the longitudinal axis of the coaxial means for propagating by a distance that substantially cancels reactive load components of the means for coupling. The antenna further includes short circuit means for terminating the means for propagating, and dipole means for radiating the respective coupled portions of the signal with rotating phase, wherein signal strength with respect to azimuth is substantially omnidirectional.

In accordance with yet another embodiment of the present invention, a method for emitting radio frequency signals with vertical polarization is presented. The method includes the steps of applying RF signals to a coaxial conductor (coax) having a longitudinal axis and a terminal short circuit, capacitively coupling a first portion of the applied RF signal from the coax to a first element of a first dipole and a first element of a second dipole at a first location along the coax, proximal to a feed end of the coax, wherein the respective elements of the first and second dipoles are located opposite one another with respect to the longitudinal axis of the coax, are coplanar with the coax, and project radially from the coax, and capacitively coupling a second portion of the applied RF signal from the coax to a first element of a third dipole and a first element of a fourth dipole at a second location along the coax, proximal to the first location and further from the feed end of the coax than the first location, wherein the elements of the third and fourth dipoles are located opposite one another with respect to the longitudinal axis of the coax, are coplanar with the coax, project radially from the coax, and lie in a plane at right angles to the plane of the first and second dipoles. The method further includes the steps of canceling reactive load components of the first, second, third, and fourth dipoles through spatial positioning of the respective locations with respect to the wavelength of the applied RF signal, orienting the dipoles to produce phase rotation and substantial omnidirectionality with respect to azimuth, and emitting the applied RF signal energy from the respective dipoles.

There have thus been outlined, rather broadly, certain embodiments of the invention, in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as in the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

Figure 1:
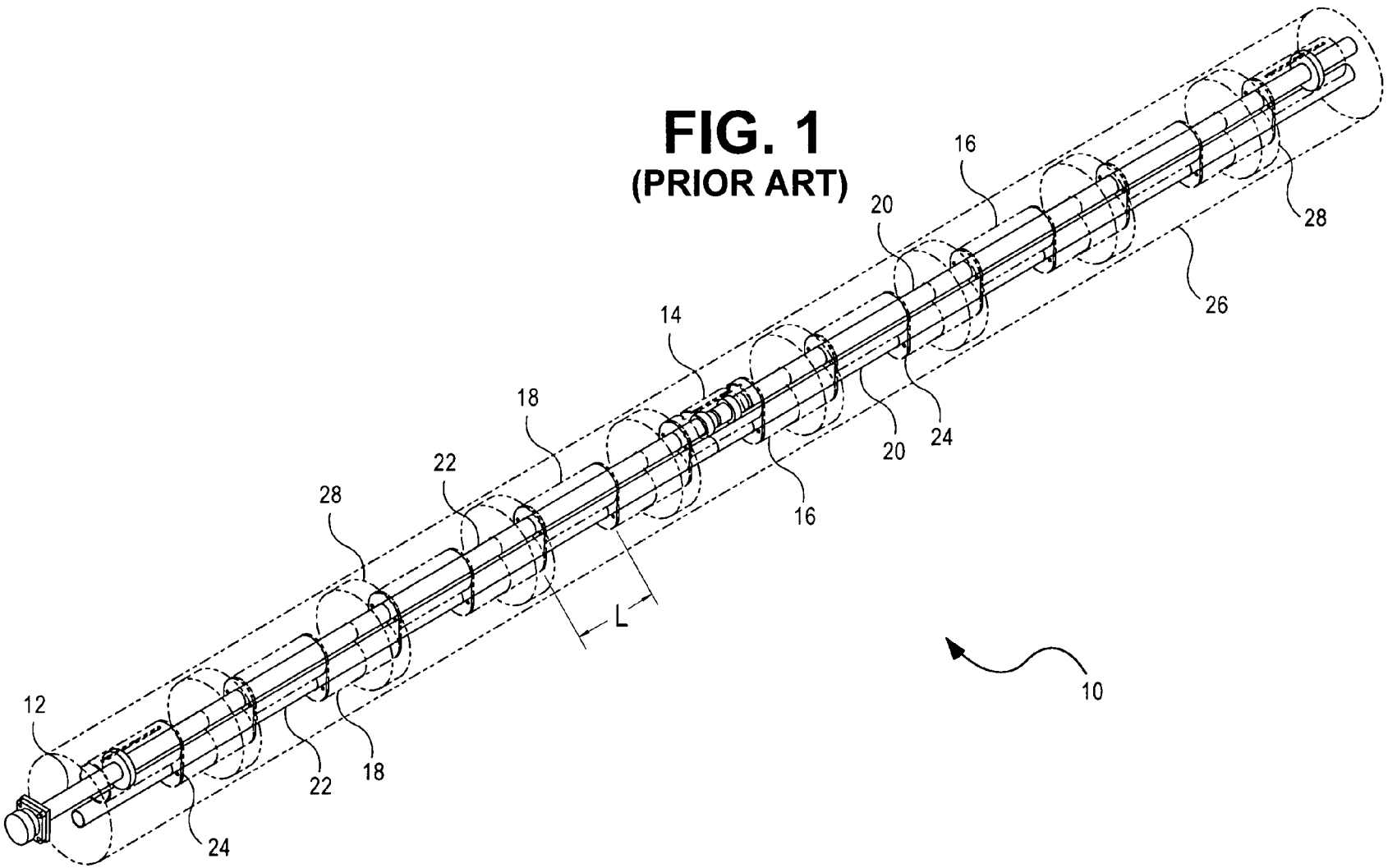
FIG. 1 (PRIOR ART)
FIG. 1 is a view illustrating a multiple-dipole whip antenna according to the prior art.

The invention will now be described with reference to the drawing figures, in which like reference numerals refer to like parts throughout. The present invention provides an apparatus and method that in some embodiments provides a vertically polarized traveling wave antenna.

FIG. 1 is a perspective view of a "whip" antenna 10 used according to known practice for broadcast and transceiver functions in the upper L band and nearby frequency bands. The particular whip antenna embodiment shown is center fed using a coax 12 to a center divider 14. From the divider 14, interleaved and stacked coax segments 16, 18 function as omnidirectional radiators while propagating the signal up and down the whip 10. Each of these coax segments 16, 18 has a center conductor 20, 22 as large as the outer conductor of the feed coax 12; indeed, the lower coax 18 uses the outer surface of the outer conductor of the feed coax 12 as its center conductor 22. In order for the antenna 10 to function as intended, the center conductors 20, 22 are bonded substantially continuously to the proximal outer conductors of the coax segments 16, 18, by soldering or another effective process. Outer conductors of each two coax segments 16, 18 are separated by a gap 24 sufficient to prevent arcing and other failures. As is well understood in the art, skin effect limits penetration of the respective signals, and impedance of the larger coaxes 16, 18 can be made to be the same as that of the feed coax, if desired, by preserving the diameter ratio and the effective dielectric constant of the respective center conductor support materials.

Signal propagation along the outside of each coax segment 16, 18 for radiation is comparable to propagation along a conductor in free space, while propagation within each coax segment 16, 18 is slower than in free space by an amount related to the size (diameter) and impedance (diameter ratio) of the coax and to the dielectric constant of the filler material within the coax segments. Thus, each segment 16, 18 is cut somewhat shorter than a free-space half wavelength of an electromagnetic wave at the center frequency. Since the signal propagates along both the inside and outside of each segment, there are impedance mismatches at each segment boundary that promote radiation and reflection.

Each coax segment 16, 18 propagates the signal by a half wave, then couples the signal into the next segment with phase reversed between the inner and outer conductors. This isolates each segment 16, 18 sufficiently to permit it to act as a monopole of the proper length to radiate efficiently at the frequency corresponding to its length. It may be observed that elements at one-wavelength intervals have the same polarity, so instantaneous signal phase at corresponding locations on these interleaved elements is equal. Since pairs of adjacent segments total one wavelength, each proximal pair act as a dipole, and the entire antenna acts as a stack of omnidirectional dipoles excited substantially in phase on successive cycles of the same signal. The radiating signal emits roughly uniformly, constrained by nonuniform element cross section, propagation distance, and surface current density, which are appreciable in view of the height-to-width proportions of the segments 16, 18.

The foregoing description does not address other attributes of this example of prior art. As is evident from the drawing, mechanical strength of the whip antenna is reduced at each junction between segments 16, 18. In practice, the tube materials are preferably soft copper or a similar material for optimum electrical performance, and may not suitable for bearing significant loads, such as the weight and wind load of the entire whip antenna 10. As a consequence, the antenna can require a relatively robust radome 26 (shown in phantom) and suitable locating spacers 28 (a foamed thermoplastic is used in the product illustrated in FIG. 1) in order to maintain its shape. In many embodiments, such a radome 26 can be somewhat RF dissipative, providing an additional negative gain factor.

Loading from connecting radiators in parallel decreases antenna impedance below the characteristic impedance of the coax from which the antenna is made. As a result, the impedance at the feed from the transmission line feeding the antenna is significantly lower than a typical coax, and must be transformed by stepwise changes in the diameter ratio of the conductors or a comparable method. Known methods for economically realizing this transformation narrow power bandwidth and introduce losses.

Length of each segment 16, 18 is a function of the operating band for which the antenna 10 is intended. In order to operate with acceptable efficiency, the segments 16, 18 should be very close to a half wavelength, in consideration of the net propagation rate of the assembly. It is intrinsic that the intersegment spacing equals the segment length L for this antenna type, so optimum performance, ordinarily at a frequency of minimum voltage standing wave ratio (VSWR), can be expected to have a radiation pattern largely perpendicular to the alignment of the coaxial feed line. In order to achieve beam tilt, radiators in any stacked array must have spacing different from one wavelength—closer for downward tilt with bottom feed, further for upward tilt, opposite for top feed. The only adjustment in physical element spacing available in the whip antenna 10 is between the upper and lower halves, or beams, and can be shown to be limited to about 1.5 degrees below the horizontal before the beams begin to exhibit separation, with appreciable loss of performance.

Figure 2:
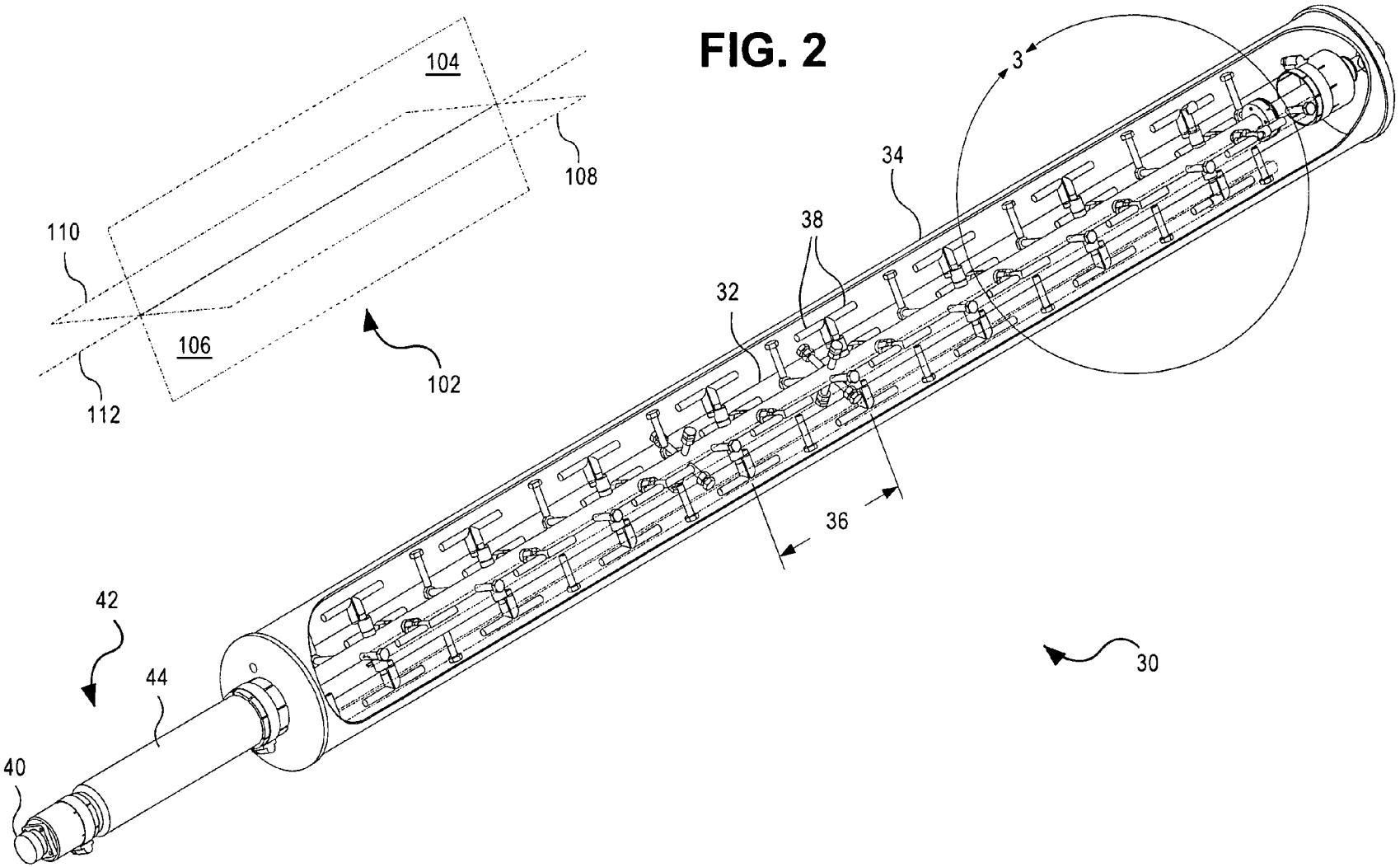
FIG. 2 is a perspective view of a vertically polarized traveling wave antenna according to the instant invention.

FIG. 2 is a perspective view of a traveling wave antenna 30 according to the instant invention. A coaxial transmission line outer conductor 32 is preferably robust, enabling the antenna to be self-supporting including wind and ice loading, so that a radome 34 can be a thin shell sufficient to minimize exposed surface area, provide low aerodynamic drag, and protect against contamination by dirt, bird contact, water intrusion, and the like. At approximately one-wavelength intervals 36 along the length of the outer conductor 32, multiple pairs of elements establish dipole radiators 38. A feed connector 40 is shown at the base 42 of the antenna 30. The base 42 includes a mounting provision such as a tubular sleeve 44 capable of being grasped by a clamping device (not shown). A reference sketch 102 shows four half-planes 104, 106, 108, and 110 bounded by a transmission line longitudinal axis, the latter coinciding with the antenna polarization axis 112. The orientation of the half-planes 104, 106, 108, and 110 and the axis 112 is the same as the orientation of the dipoles 38 and the antenna 30 in FIG. 2.

Figure 3:
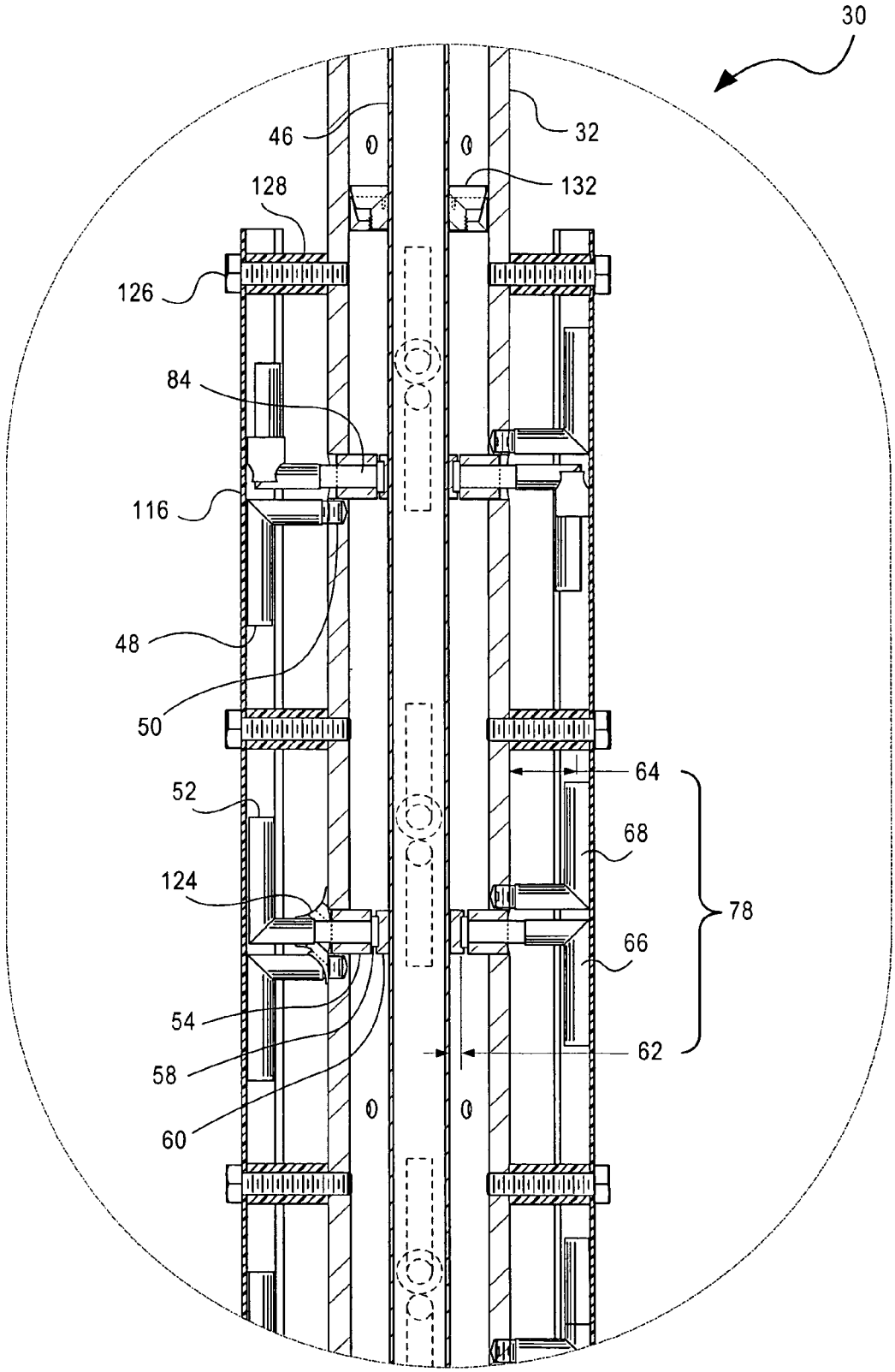
FIG. 3 is a partial section view of the antenna of FIG. 2.

FIG. 3 is a partial section view of the antenna 30 of FIG. 2, less the radome 34, showing the outer conductor 32 and a center conductor 46 in section, and further showing representative radiating elements. A first-type ("cold" and grounded) element 48 is pressed into a blind hole 50 in the outer conductor 32. This can be a substantially permanent arrangement, using an undersized hole for an interference fit. As is well known in the art, pressed-together assembly disrupts surface oxides and establishes micro-welds that provide electrical continuity and mechanical retention in proportion to the extent of interference. By using similar materials for the outer conductor 32 and the cold element 48, such as an aluminum alloy suitable for casting and an aluminum alloy suitable for extrusion and machining, respectively, differential thermal expansion and thus temperature-related loosening of the assembly can be largely eliminated. Cold flow (in the case of typical aluminum alloy compositions and tempering methods) ultimately relieves residual strain, but the micro-welds maintain assembly integrity.

Additional or alternative processes may be applied in some embodiments to provide easy and rapid assembly and to assure long-term mechanical and electrical union. It should be noted in this context that among the most costly aspects of providing communication apparatus, in terms of both money and time, can be installing and moving antennas, particularly on towers. Providing a structurally robust antenna, one unlikely to lose functional integrity, such as by rendering one of its radiative elements lossy or noisy, can be of significantly greater economic importance than providing field maintainability, for example, or absolutely minimizing manufacturing cost. Indeed, many "small" antennas can be viewed as disposable. Thus, the method selected for attaching the cold elements 48, whether by pressing, MIG welding, pinning, or another method, may be of less importance than the reliability achieved. Similarly, choosing to form the holes 50 blind, as indicated above, or as through holes, and to shape the interface between the cold element 48 and the hole 50 as cylindrical or as including one or more ridges, knurls, or other features, may be decided for an embodiment according to the intended environment and service life.

As further shown in FIG. 3, a second-type ("hot" and coupled to the RF signal source) element 52, is surrounded at least in part by a dielectric sleeve 54 fitted into an aperture/pass hole 56 in the outer conductor 32. The hot element 52 terminates in a conductive foot 58 and is capped with a dielectric shoe 60 that bears against the center conductor 46. The spacing 62 between the foot 58 and the center conductor 46 in the presence of the dielectric shoe 60 and such air gaps as occupy remaining volume proximal to the linkage define a capacitor whereby the hot element 52 is coupled to the center conductor. The hot element 52 carries this signal through the aperture 56 in the outer conductor 32, with the reactive properties of this arrangement determined by structural details such as element and hole diameter ratio, effective insulating spacer dielectric constant, and the like. In the embodiment shown, the structure is so arranged that the hot element 52 appears as an effective 50 ohm transmission line stub. Outside the outer conductor 32, the cold and hot elements 48 and 52, respectively, have a spacing 62 that establishes the interaction between the elements 48 and 52 and the interaction between these and the grounded outer conductor 32.

The two elements 48 and 52 then turn away from each other at right angles in the embodiment shown, forming a dipole having a principal axis parallel to the longitudinal axis of the outer conductor 32. The summed lengths of the radiative parts 66 and 68 are selected in the embodiment shown to jointly approximate a half-wavelength of the center or midband frequency of the antenna 30. The extension distance 64 from radiators 66, 68 to the grounded, cylindrical surface of the outer conductor 32 in large part determines the radiation pattern of each single dipole. A value for dipole length and extension distance 64 may be estimated using the formulas of Philip S. Carter, as published in the seminal paper, "Antenna Arrays Around Cylinders," in the *Proceedings of the I. R. E.*, December, 1943 (retained by successor IEEE, Piscataway, N.J.), following the method by which Carter develops a cylinder surrounded by multiple dipoles in a layer. This value may be verified using physical models. It is noteworthy that Carter's results are faulty in some of his examples, since his manual methods were clearly onerous and he failed to step to convergence in some cases. The invalid results can be replicated by shortening the series in those cases. Carter's approach is nonetheless demonstrably valid, and modern numerical methods reliably predict physical model results. Note: the term "bay" is used herein in general in reference to a structural grouping, while a "layer" refers to electrical and functional behavior of the devices making up such a grouping. The sense of the terms has overlap, and use of one in place of the other herein is not intended to be dispositive.

Figure 4:
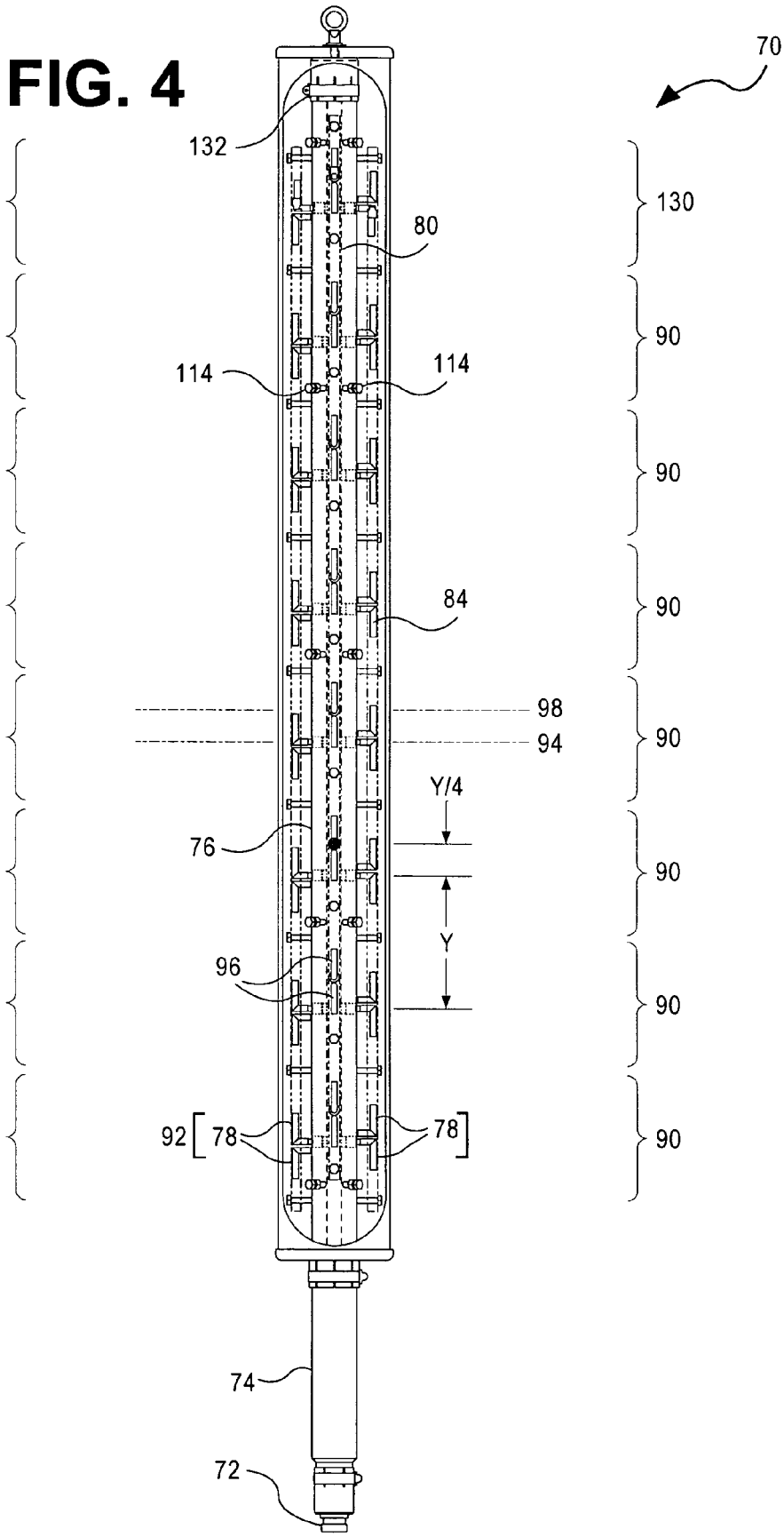
FIG. 4 is a view of the antenna with the radome cut away.

FIG. 4 is a frontal view (radome cut away) of a complete 8-bay vertically polarized traveling wave antenna 70 according to the instant invention. The antenna 70 uses a simple feed method. RF is applied at the bottom through a conventional connector 72, functioning as an origination node for the antenna 70. A mounting strut section 74 can enclose a transformer (not shown) as needed for impedance matching. The outer conductor 76 of a coaxial transmission line serves as a supporting pole for the antenna 70, and power is tapped off from the center conductor 80 at each radiator 78, eliminating the need for any power divider apparatus or for feed lines to the radiators 78.

Figure 5:
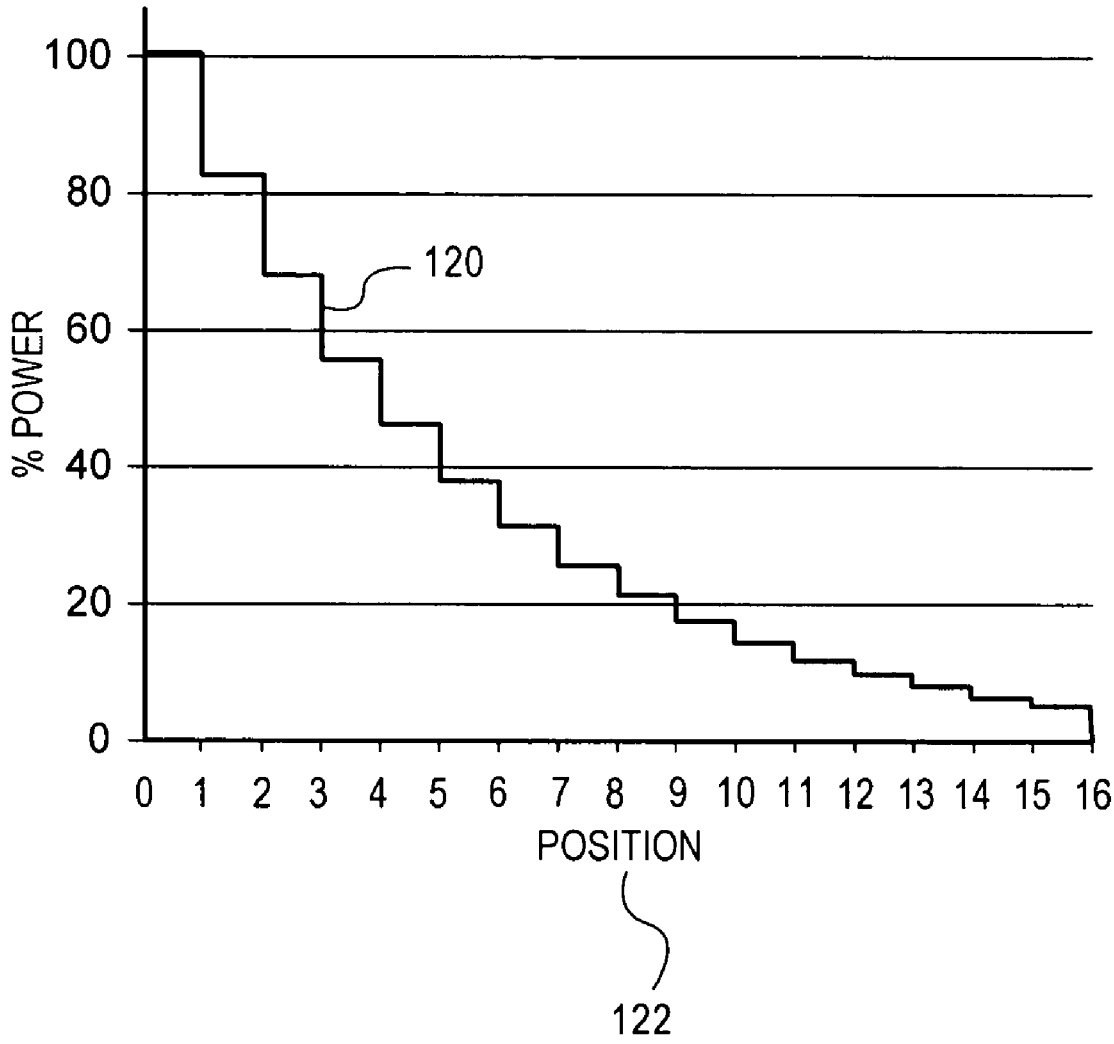
FIG. 5 is a plot of signal energy versus array position of the antenna of FIG. 2.

As shown in FIG. 5, in embodiments wherein the coupling fittings are essentially identical, the traveling wave of the applied signal has a stepwise attenuated energy profile 120. In FIG. 5, the locations 122 of the radiators, counting from the bottom of the vertically-oriented antenna, are shown as the abscissa, while the remaining signal energy exhibits substantially logarithmic amplitude taper. The power level is expressed in FIG. 5 as a percentage of the power originally applied.

Returning to FIG. 3, the antenna 30 uses sets of center-fed dipole radiators 78, which are capacitively coupled to the coaxial inner conductor 46. The dipoles are mounted around the periphery of the coax outer conductor 32, with a hot monopole 52 of each dipole 78 having the form of a capacitive probe 84 accurately spaced from the inner conductor 46 and a cold monopole 48 grounded directly to the coax outer conductor 32. The probe 84 is capped with a dielectric shoe 60, which forms a spacer between the probe 84 and the inner conductor 46. The amount of coupling can be controlled by varying the thickness of the shoe 60. This in turn controls the amplitude taper along the aperture of the antenna discussed above with respect to FIG. 5.

Returning to FIG. 4, each bay 90 uses four dipoles 78. One set of two dipoles 92 is located on a first elevation plane 94, with the dipoles 78 mounted 180 degrees apart from each other in azimuth. The second set of two dipoles 96 is located on a second elevation plane 98 one quarter midband wavelength above the first plane 94 but rotated 90 degrees in azimuth relative to the first set. Since the four dipoles 78 are arranged in quarter-wave sets (as shown in FIG. 2, two perpendicular planes 104/108 and 106/110, respectively, each including the antenna axis 112, are fed in phase quadrature), the reactive components of the impedances of the four dipoles 78 cancel, and the dipoles 78 in the bay 90 effectively form a matched layer that has only attenuation (realized in the form of radiation) and no reflection. See Masters, R. W., U.S. Pat. No. 2,947,988, awarded Aug. 2, 1960, for discussion of impedance cancellation.

Within each bay 90, the second dipole 78 of each set of two dipoles 92 is inverted with respect to the first, creating a 180 degree phase reversal. The second set of two dipoles 96 is located one-quarter wavelength above the first set, creating an additional 90 degree phase delay. This arrangement produces a 0-90-180-270 rotating phase relationship around the antenna, advancing to the right viewed from below in the embodiment shown, resulting in an azimuth pattern that is effectively omnidirectional. The position of the first elevation plane 94 is also referred to herein as a reference locus, that is, a point within that bay distinct from corresponding points within the other bays. Each bay may be viewed as having a reference locus, congruent as presented herein with the intersections of the respective first hot element 84 feed axes with the longitudinal axis (112 of FIG. 2) of the antenna 70.

In the arrangement shown, all the dipoles 78 in any one vertical plane and on one side of the antenna (i.e., lying in one of the four perpendicular half-planes 104, 106, 108, and 110, respectively, bounded by the antenna longitudinal axis 112) are in phase, beam tilt and null fill excepted. Phase difference between dipoles 78 in successive half-planes equals azimuth angle difference between the successive half-planes, that is, phase rotates around the antenna longitudinal axis 112. The far-field signal at intermediate azimuths tends to sum the impinging energy from the dipoles 78, including interaction with the outer conductor 76, yielding intermediate phase angles. Since all the bays 90 (each consisting of two sets of two dipoles 92 and 96, respectively) are identical except as noted in the embodiment shown, the matched condition remains true for any number of bays 90.

For the following discussion, it is to be understood that some antenna embodiments according to the instant invention may have a working bandwidth that is a small fraction of an octave—that is, may be intended for use for wavelengths differing by no more than a few percent. References to "frequencies" and "wavelengths" herein, while explicitly accurate only for a midband frequency of the working bandwidth, may be used in some embodiments without significant error for multiple channels over entire bands of signals.

"Aperture" as normally understood in the art and as used herein signifies the length of the radiative portion of an antenna, generally from the bottom of the lowest active component to the top of the highest for a vertical antenna. Thus, for a single dipole in free space, the aperture would be the entire, end-to-end length of the dipole, while for a vertically oriented multiple-element array, the aperture is the extent from the bottom of the lowest active element to the top of the highest.

"Beam tilt" as used herein signifies deflection of the direction of maximum emission of an omnidirectional antenna for the purpose of directing the signal toward receiving devices located below the height of the antenna. As known in the art and as used herein, beam tilt for multiple-bay antennas with significant gain and thus a flattened main beam and possible sidelobes refers to deflection of peak signal from a planar disk perpendicular to the antenna longitudinal axis to a (typically shallow) cone, still radially symmetric about the antenna axis, and ordinarily directed groundward. Receive sensitivity for a receiving or transceiving antenna is typically enhanced by beam tilt to roughly the same extent as transmit range for a transmitting or transceiving antenna. Downward beam tilt from a bottom fed antenna is generally achieved by shortening the distance between bays from a nominal one wavelength, while upward beam tilt, which might apply for broadcasts directed to aircraft, for example, or downward beam tilt where an antenna is top fed, is generally achieved by increasing the distance between bays.

Since a traveling wave has a linear phase characteristic, the excitation of successive bays will lag with respect to previous bays according to the spacing between the bays. If no beam tilt is employed, the bay spacing, indicated as "Y" in FIG. 4, may be set to one wavelength, resulting in a relative phase along the aperture of zero. Beam tilt can be incorporated by uniformly reducing the spacing "Y" between bays to less than a wavelength. This will add a controlled and linear phase taper which results in the desired beam tilt without disturbing such other characteristics of the antenna 70 as input impedance and azimuth pattern. Since this phase taper is progressive, i.e., is spread out along the entire aperture, large beam tilts are possible without degrading the gain of the antenna 70. This contrasts with known center-fed whip designs, such as that shown in FIG. 1, wherein the segments 16, 18 must be uniformly one-half wavelength (as measured within the coax) in physical length to provide uniform and real impedance, so that beam tilt is restricted to being forced at a single point.

Returning to FIG. 3, other dimensions and properties of the cold and hot elements 48 and 52, respectively, such as thickness, radius of any curvature in the turn, end shape, whether the element is uniform and/or cylindrical in cross section, and the like, may be developed according to conventional antenna principles and validated for individual embodiments. In at least some embodiments, elements 48 and 52 may be die castings of generally cylindrical profile, roughly 4% of a wavelength in diameter. The foot 58 may be on the order of twice the diameter of the hot element 52. Dielectric constant and thickness of the shoe 60 separating the foot 58 from the coax center conductor 46 determine capacitive coupling, and are thus functions of the required coupling coefficient, in consideration of the number of bays 90 of FIG. 4, the frequency band of the antenna 70, the desired null fill (discussed below), and the like. A typical dimension for the separating thickness of a shoe 60 made from a plastic having a dielectric constant of about 2 may be on the order of 2% of a wavelength for some embodiments, while the corresponding dimension in the terminating layer or bay 130 may be smaller by an order of magnitude.

Figure 6:
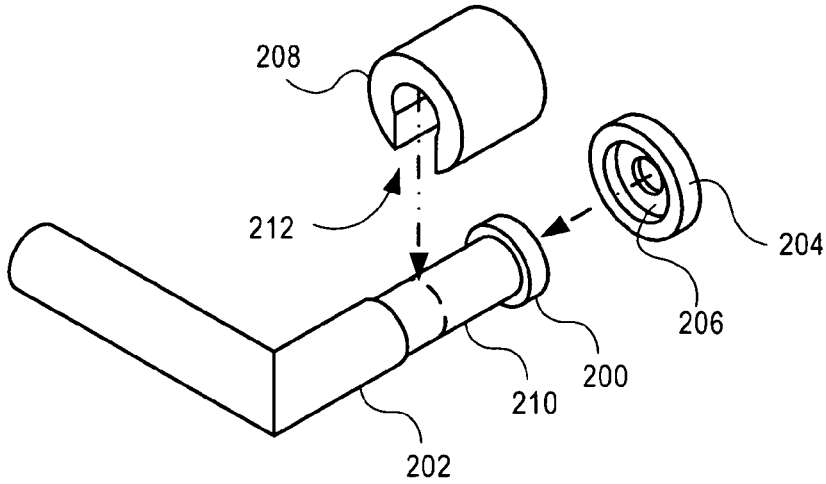
FIG. 6 is a view of a hot element with integral foot.

Construction details of the hot element 52 may vary according to the requirements of an embodiment. For example, as shown in FIG. 6, the foot 200 may be cast integrally with the element 202, with a shoe 204 having a recess 206 to accept the foot 200. A slotted or split insulating sleeve 208 may be clipped over the shank 210 of the element 202 in some embodiments. The sleeve 208 may be forced or wrapped over the element 202. Note that in at least some embodiments, the effective dielectric coefficient of the interface between the shank 210 and the aperture 56 in the outer conductor 32, as shown in FIG. 3, may be the combined dielectric coefficients of the thermoplastic sleeve 208, a passage 212 if needed, and any unfilled volume between the non-contact portions of the shoe 204 and the inner conductor.

Figure 7:
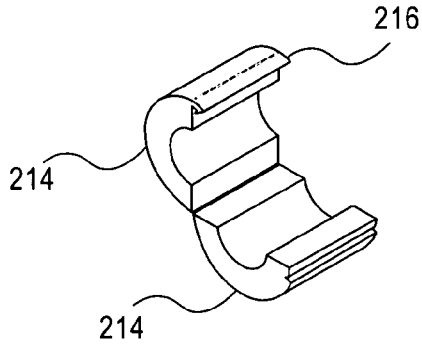
FIG. 7 is a view of another sleeve to enclose a hot element.

A sleeve likewise may be formed as a single piece with self-hinged halves 214 as shown in FIG. 7, with halves optionally clipped together with an integral barb 216 or a separate fastening band, or formed as two or more separate pieces. In other embodiments, the foot 200 of FIG. 6 may be separate, and may be pressed, threaded, riveted, bolted, welded, or otherwise conductively attached to the element 202 before or after affixing a sleeve 208 over the shank 210.

Figure 8:
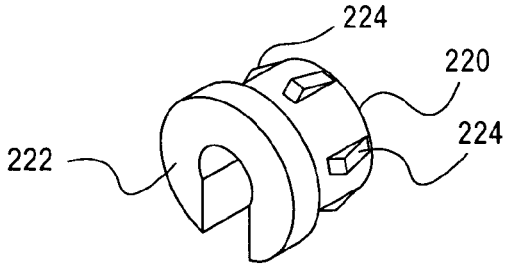
FIG. 8 is a view of yet an alternative sleeve embodiment.

As shown in FIG. 8, the sleeve 220 may have a shoulder 222, such as to establish a maximum insertion depth, may be a loose or press fit in the coax outer conductor, and may include one or more retention barbs 224 in some embodiments. Sleeve material for any configuration may be any suitable dielectric, including such thermoplastics as polyoxymethylene (POM), polytetrafluoroethylene (PTFE), polycarbonates, perfluoroalkoxy polymer resin (PFA), and polyethylenes, including ultra-high molecular weight polyethylene (UHMWPE), and appropriate mixtures thereof, and may include suitable fillers. Other thermoplastic materials, such as some polyamides (PA), may be susceptible to deterioration—embrittlement, dimensional change, and the like—in the presence of some levels of electromagnetic fields, so that selection of suitable materials for the antenna may require attention to information such as product data sheets to assure resistance to deterioration.

Provided the outer diameter of the sleeve 208 of FIG. 6 exclusive of any shoulder is not smaller than that of the shoe 204, the assembled hot element 52 can be inserted from outside the coax outer conductor 76 of FIG. 4. This can reduce time and skill—and thus cost—for antenna 70 assembly.

As further shown in FIG. 4, this type of feed also provides a method of support for the inner conductor 80. That is, any coaxial line requires that the inner conductor 80 be positioned accurately and stably with respect to the outer conductor 76, so that their longitudinal axes 112, represented in FIG. 2, coincide. Errors of concentricity affect impedance and current density uniformity, and can cause reflections and heating losses. Common types of coax, such as transmission lines, use continuous solid or foamed dielectric, discrete disks (sometimes termed "beads") or posts placed periodically along the coax, and numerous other methods. The antenna feed in the instant invention places multiple capacitive probes 84 in direct contact with the inner conductor 80 at positions fully surrounding the inner conductor 80 at regular distances therealong, providing positive location with respect to the outer conductor 76. In some embodiments, additional fastenings 114 that may be termed transmission line concentricity adjusters can be used to aid initial assembly, to fine tune inner conductor 80 concentricity with the outer conductor 76, and the like; these may be located in planes perpendicular to the polarization axis at selected longitudinal positions, and may be left in place permanently to provide additional transmission line stabilization.

Figure 9:
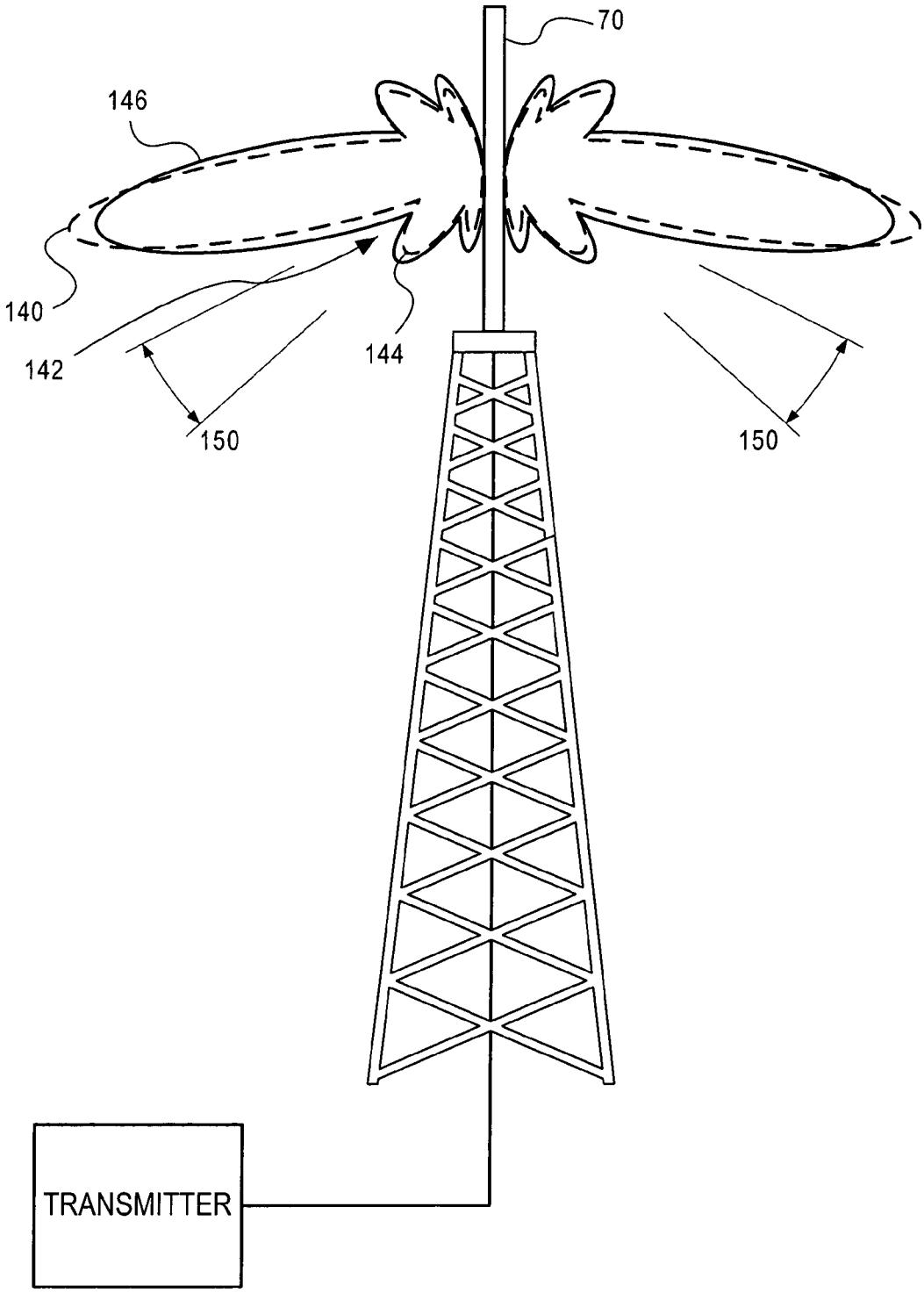
FIG. 9 is a schematic view of null fill.

FIG. 9 is a schematic representation of null fill alteration. Null fill can be used to reduce the tendency of a high-mounted high-gain antenna to have one or more annuli of very weak signal strength nearly underneath the antenna. Null fill can be altered in some embodiments by controlling coupling of the dipole radiators 78. Particular coupling values for dipoles 78 can produce a strong center lobe 140 and a deep null 142 before the first sidelobe 144, shown as the dashed signal in FIG. 9, resulting in the occurrence of an annulus of poor reception 150 surrounding an antenna 70. Altering coupling, and thus mating face thickness of shoes 60 as shown in FIG. 3 for one or more bays can reduce the center lobe energy 146 to a minor extent while appreciably decreasing the depth of the null 148, as shown in the solid signal in FIG. 9.

Returning to FIG. 3, retention of probes 84 by friction or like forces may be augmented in some embodiments. In order to further assure positioning accuracy, all of the dipoles 78 can be captured within substantially RF transparent and RF stable stabilization devices 116 that enhance alignment and retention. In the embodiment shown in FIG. 3, polycarbonate or another thermoplastic with suitable properties can be used in stabilization devices 116 passing over dipoles 78 in the half planes 104, 106, 108, and 110 shown in FIG. 2. In some embodiments, stabilization devices 116 may be produced by longitudinally slitting or removing material from a tube of suitable diameter and wall thickness. The stabilization device 116 of FIG. 3 may be further stabilized with retainers 126 and/or spacers 128 as suited for a specific embodiment. The retainers 126 and spacers 128 in the embodiment shown use nonconductive, low dissipation factor, RF stable thermoplastic machine screws driven into threaded holes in the outer conductor 76; different devices are possible in other embodiments. In other embodiments, augmented retention may be achieved using adhesive applied to each of the probes 84. Particular adhesives can combine good adhesion to the material of the outer conductor 32 and good long-term stability with desirable dielectric properties; such adhesives can be economical to apply while providing stabilization for the life of the antenna, if applied as a fillet 124 (shown in FIG. 3, although not necessarily applicable to that embodiment), provided the fillet 124 makes adequate contact with the hot probe 84 and the outer coax 32.

Along the main aperture (i.e., the length of the radiating portion of the antenna), each bay extracts and radiates a portion of the energy from the traveling wave. For example, as shown in FIG. 4, a specific prototype with a uniform physical arrangement can extract about 1.5 dB of the remaining signal at each bay 90. That is, about 18% of the signal is extracted at the first bay, 18% of the remaining signal is extracted at the next bay, and so on. As a result, only a small percentage of the signal remains at the top of the antenna 70. The remaining energy can be radiated by an end configuration combining an end bay 130, substantially in phase with the remainder of the aperture, and an end termination 132 (also shown in FIG. 3). The end bay 130 is a heavily loaded equivalent of the other bays 90; this is followed by the end termination 132, a short circuit spaced away by another quarter wavelength. The loading at the end bay 130 can be made heavier by thinning the dielectric shoes 134, thereby increasing the coupling capacitance between the probes 136 and the inner conductor 80. In presenting an effective open circuit after the last bay of radiators, the end termination 132 provides a proper (non-reactive, non-reflective) termination for the coaxial transmission line formed from the inner and outer conductors of the antenna 70.

The simple construction of the instant invention allows potential for low manufacturing cost. The support mast/outer conductor 76 can be mass drilled with multiple drill heads drilling simple holes oriented toward the centerline of the outer conductor 76. Since successive bays 90 can be made identical, the dipoles 78 and dielectric shoes 88 can be formed by casting, molding, stamping, or other potentially high-precision, high-volume, low-labor methods, largely eliminating machining of the conductive and insulating components. Assembly does not require thermal welding or soldering and becomes an unskilled task of pressing the cold dipoles into blind holes and "popping" the hot dipole assemblies into through holes. This combination of simplicity and RF performance promises a competitive advantage over traditional whip style antennas, while compact size, robust structure, and durable materials promise long life without maintenance.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described; accordingly, all suitable modifications and equivalents may be resorted to that fall within the scope of the invention.

What is claimed is:

1. A vertically polarized traveling wave antenna, comprising:

a coaxial transmission line having an inner conductor and an outer conductor with a common longitudinal axis, wherein the transmission line originates at an origination node and ends at a terminal node; and a dipole comprising a first-type element and a second-type element, wherein radiating parts of the first-type and second-type elements comprise substantially collinear conductors having an axis parallel to an antenna polarization axis, wherein feed parts of the first-type and second-type elements are conductors having axes perpendicular to the polarization axis, wherein the feed parts are connected to respective radiating parts, wherein the first-type element is conductively coupled to the outer conductor and the second-type element is capacitively coupled to the inner conductor with an effective position comprising a coupling locus, and wherein the second-type element feed part passes without conductive contact through an aperture in the outer conductor.

2. The antenna of claim 1, further comprising a radiating bay, wherein the radiating bay comprises:

a first pair of substantially identical dipoles having principal axes of the respective parts lying in a first plane that includes the coax longitudinal axis, wherein the coupling loci of the second-type elements of the first pair are located on opposite sides of the inner conductor and are substantially collinear, wherein the radiating parts of the second-type elements of the first pair are equidistant from the polarization axis and are oriented oppositely to one another with respect to a direction from the origination node to the termination node of the transmission line, wherein the first-type elements of the first pair are respectively connected to the outer conductor above the origination-node-oriented second-type element and below the termination-node-oriented second-type element; and a second pair of dipoles, configured and arranged substantially identically to the first pair, lying in a second plane that includes the coax longitudinal axis, wherein the second plane is perpendicular to the first plane, wherein the coupling loci of the second-type elements of the second pair are one quarter wavelength further from the origination node than the coupling loci of the second-type elements of the first pair, wherein reactive components of impedance within the radiating bay substantially cancel, whereby the dipoles of the radiating bay effectively form a matched layer substantially free of reflection, and whereby attenuation within the matched layer is realized in the form of radiative signal emission, and wherein the radiating bay has a reference locus on the polarization axis associated with the coupling loci of the elements thereof.

3. The antenna of claim 2, further comprising a plurality of radiating bays distributed along the transmission line.

4. The antenna of claim 3, wherein principal axes of radiating parts of corresponding elements in respective radiating bays are substantially collinear, whereby corresponding elements lie in common half-planes bounded by the polarization axis.

5. The antenna of claim 4, further comprising successive radiating bays whereof the respective reference loci are positioned along the transmission line at intervals of one wavelength of a specified frequency within the transmission line.

6. The antenna of claim 4, further comprising a beam tilt established by altering interbay spacing from a nominal uniform bay spacing between each two adjacent reference loci of one wavelength of a specified frequency, as defined by propagation rate within the coaxial transmission line, to a substantially uniform bay spacing between reference loci differing from the nominal spacing at least in proportion to specified beam tilt magnitude and direction, wherein the beam tilt is directed toward the origination node for spacing less than one wavelength and away from the origination node for spacing greater than one wavelength.

7. The antenna of claim 4, further comprising:

a null fill established by altering interbay spacing from equal spacing between reference loci to a spacing wherein at least one reference locus is displaced from uniform spacing, whereby at least one null in nominal antenna signal strength variation with elevation angle is reduced in magnitude.

8. The antenna of claim 3, wherein the second-type elements further comprise:

conductive feet terminating the second-type elements, wherein each of the feet is conductively connected to a respective element feed part distal to the radiating part thereof, wherein respective surfaces of the feet proximal to the transmission line inner conductor have conformations compatible with function as capacitive couplers;

insulating shoes fitted to the respective conductive feet, wherein the shoes have substantially stable dimensions, dielectric constants, and dissipation factors, whereby spacings and capacitive couplings between the respective feet and the transmission line inner conductor are established at specifiable and maintainable values; and insulating spacing bodies occupying at least a part of a volume between extents of the respective apertures in the outer conductor and proximal regions of the respective feed parts of the second-type elements, wherein the spacing bodies position the second-type elements at least in part, and wherein the spacing bodies comprise materials capable of achieving substantially stable dimensions, dielectric constants, and dissipation factors.

9. The antenna of claim 8, wherein the terminal node further comprises:

a last radiating layer, furthest from the origination node, wherein a coupling coefficient realized through determination of dimensions and materials of the feet, shoes, and spacing bodies of the second-type elements is configured to present a substantially nonreflective termination; and a terminal reflective short circuit between the inner and outer conductors of the transmission line, so positioned with respect to antenna operating frequency that electromagnetic energy not coupled from the transmission line by the last radiating layer during propagation of the energy from the origination node is reflected from the short circuit and presented back at dipoles distal to the antenna origination node with substantially zero reactive component magnitude.

10. The antenna of claim 4, further comprising:

a guide assembly to provide position and alignment reinforcement for a dipole group, wherein the dipole group includes at least one dipole, wherein the element principal axes of the dipole group lie in a half-plane bounded by the polarization axis, wherein the guide assembly comprises:

a nonconductive body, wherein the body is oblong in form and has a transverse section so configured as to affix to and engage the radiating parts of elements comprising at least one dipole, whereby the radiating parts otherwise capable of rotating at least to an extent are generally constrained into coaxial alignment;

at least one restraint fitting, configured to restrain the nonconductive body with respect to the transmission line outer conductor; and a provision for securing the at least one restraint fitting to the transmission line outer conductor.

11. The antenna of claim 4, further comprising:

a guide provision for position and alignment for a dipole element, wherein the guide provision is selected from the group consisting of:

an adhesive, wherein the adhesive is so applied to an outer conductor and a dipole element as to bond the outer conductor and the element in substantially permanent alignment;

a keyed insert configured to provide positive rotational alignment between a keyed outer conductor feed aperture and a keyed dipole element; and an insert configured to provide rotational alignment between an outer conductor feed aperture and a dipole element, wherein the element is constrained in rotational orientation and depth of penetration through use of any combination of friction, interference fit, insert resilience, protrusion deformation, surface nonuniformities in the aperture, and surface nonuniformities of the element.

12. The antenna of claim 1, further comprising a plurality of sets of transmission line concentricity adjusters, wherein each set of adjusters is configured to adjustably define a location for the inner conductor with respect to the outer conductor, at a longitudinal position, whereby concentricity of the outer and inner conductors of the transmission line is stabilized.

13. The antenna of claim 3, further comprising a radome configured to enclose the radiative elements of the antenna, wherein such region of the radome as signals emitted from the antenna radiative elements pass through consists at least in part of a substantially nonconductive material having resistance to deterioration resulting from solar and electromagnetic signal irradiation.

14. The antenna of claim 3, further comprising a mounting provision whereby the antenna is affixable to a structure, wherein the mounting provision is a portion of the antenna configured to be mechanically engaged substantially permanently, and wherein the mounting provision is linked to the remainder of the antenna with sufficient mechanical integrity to maintain alignment therebetween over foreseeable external loading.

15. A vertically polarized traveling wave antenna, comprising:

coaxial means for propagating an electromagnetic signal;

capacitive means for coupling a first portion of the signal from the coaxial means for propagating at a first location, wherein the capacitive means for coupling a first portion includes a first two discrete elements located opposite to one another with respect to a longitudinal axis of the coaxial means for propagating;

capacitive means for coupling a second portion of the signal from the coaxial means for propagating at a second location, wherein the capacitive means for coupling a second portion includes a second two discrete elements located opposite to one another with respect to a longitudinal axis of the coaxial means for propagating, wherein the first and second locations are spatially separated along the longitudinal axis of the coaxial means for propagating by a distance that substantially cancels reactive load components of the means for coupling;

short circuit means for terminating the means for propagating; and dipole means for radiating the respective coupled portions of the signal with rotating phase, wherein signal strength with respect to azimuth is substantially omnidirectional.

16. The antenna of claim 15, further comprising:

means for coupling additional portions of the signal from the coaxial means for propagating at a plurality of locations along the means for propagating, wherein reactive load components of the means for coupling additional portions are canceled;

means for radiating the additional portions of the signal at spatial intervals compatible with reinforcement of net radiated signal strength; and means for establishing beam tilt over a broad range by adjusting spacing between the plurality of locations of the means for coupling.

17. The antenna of claim 15, further comprising means for affixing the antenna to a structure, wherein the means for affixing is configured to permit substantially permanent mechanical engagement, and wherein the means for affixing is linked to the remainder of the antenna with sufficient mechanical integrity to maintain alignment therebetween over foreseeable external loading.

18. A method for emitting radio frequency electromagnetic (RF) signals with vertical polarization, comprising the steps of:

applying RF signals to a coaxial conductor (coax) having a longitudinal axis and a terminal short circuit;

capacitively coupling a first portion of the applied RF signal from the coax to a first element of a first dipole and a first element of a second dipole at a first location along the coax, proximal to a feed end of the coax, wherein the respective elements of the first and second dipoles are located opposite one another with respect to the longitudinal axis of the coax, are coplanar with the coax, and project radially from the coax;

capacitively coupling a second portion of the applied RF signal from the coax to a first element of a third dipole and a first element of a fourth dipole at a second location along the coax, proximal to the first location and further from the feed end of the coax than the first location, wherein the elements of the third and fourth dipoles are located opposite one another with respect to the longitudinal axis of the coax, are coplanar with the coax, project radially from the coax, and lie in a plane at right angles to the plane of the first and second dipoles;

canceling reactive load components of the first, second, third, and fourth dipoles through spatial positioning of the respective locations with respect to the wavelength of the applied RF signal;

orienting the respective dipoles to produce phase rotation and substantial omnidirectionality with respect to azimuth; and emitting the applied RF signal energy from the respective dipoles.

19. The antenna of claim 18, further comprising:

coupling additional portions of the signal from the coax at a plurality of locations therealong with additional groups of dipoles, wherein the positions of the additional dipoles within the respective groups are selected to substantially cancel reactive load components of the additional groups of dipoles;

positioning the additional groups of dipoles at spatial intervals along the longitudinal axis compatible with reinforcement of net radiated signal strength;

emitting the additional portions of the signal energy from the respective additional dipoles with phase rotation and azimuthal omnidirectionality; and establishing beam tilt by adjusting spacing between the groups of dipoles.

20. The antenna of claim 18, further comprising selecting values of capacitive coupling for dipoles proximal to the termination short circuit such that substantially non-reactive termination is achieved.

* * * * *